US008919608B2

(12) United States Patent
Smith et al.

(10) Patent No.: US 8,919,608 B2
(45) Date of Patent: Dec. 30, 2014

(54) DISPENSING CONTAINER

(75) Inventors: Matthew Eric Smith, Isle of Man (GB); Karl Mondszein, Mansfield (GB)

(73) Assignee: Carbonite Corporation, Panama (PA)

( * ) Notice: Subject to any disclaimer, the term of this patent is extended or adjusted under 35 U.S.C. 154(b) by 340 days.

(21) Appl. No.: 13/130,509

(22) PCT Filed: Dec. 1, 2009

(86) PCT No.: PCT/GB2009/002794

§ 371 (c)(1),
(2), (4) Date: Aug. 15, 2011

(87) PCT Pub. No.: WO2010/067047

PCT Pub. Date: Jun. 17, 2010

(65) Prior Publication Data

US 2011/0290824 A1 Dec. 1, 2011

(30) Foreign Application Priority Data

Dec. 9, 2008 (GB) ..... 0822447.9

(51) Int. Cl.
*B67D 1/00* (2006.01)

(52) U.S. Cl.
USPC ..... 222/83.5; 222/145.5; 222/213; 222/487; 222/494; 220/174; 137/512.4; 137/852; 215/309; 215/387; 206/219

(58) Field of Classification Search
USPC ..... 220/714; 604/82, 87–89, 91; 137/512.4, 137/843, 849, 852–859; 215/260, 309, 311, 215/387–389; 206/219–222; 222/80–91, 222/145.4–145.6, 129, 478, 481–481.5, 222/487, 207, 212–213, 215, 490, 494
See application file for complete search history.

(56) References Cited

U.S. PATENT DOCUMENTS 3,802,604 A * 4/1974 Morane et al. ..... 222/83
3,968,872 A * 7/1976 Cavazza ..... 206/222

(Continued)

FOREIGN PATENT DOCUMENTS

EP 0810164 A1 12/1997
FR 2814156 A1 3/2002
WO 2008/059204 A1 5/2008

OTHER PUBLICATIONS

PCT International Search Report for PCT/GB2009/002794 dated Sep. 3, 2010.

*Primary Examiner* — Paul R Durand
*Assistant Examiner* — Andrew P Bainbridge
(74) *Attorney, Agent, or Firm* — Kaplan Breyer Schwarz & Ottesen, LLP; Harry K. Ahn

(57) ABSTRACT

A container for dispensing a two-component liquid comprises an outer resilient container for containing one component with a neck defining an opening and an inner tubular container. The inner container contains a piston slidably received within it. A closure member extends over the entire area of the inner container and closes its lower end. The piston and the inner container define a reservoir for containing a second component. The neck carries a closure cap which affords a liquid dispensing opening. A first non-return valve communicates with the liquid dispensing opening and with the interior of the inner container. An airflow path extends through the closure cap and the piston and includes a second non-return valve. The first non-return valve is arranged to permit liquid to flow from the inner container to the liquid dispensing opening and the second non-return valve is arranged to permit air to flow through the airflow path into the inner container. The closure cap cooperates with the piston so that movement of the closure cap in the downward direction results in movement of the piston towards the closure member. A finger connected to the piston contacts the closure member and moves it and thus opens the inner container, thereby permitting the component within it to fall down into the component within the outer container.

16 Claims, 3 Drawing Sheets

(56) References Cited

U.S. PATENT DOCUMENTS

| | | | | | |
|---|---|---|---|---|---|
| 4,057,177 | A * | 11/1977 | Laauwe | 222/215 |
| 4,591,050 | A * | 5/1986 | Finke et al. | 206/222 |
| 5,472,122 | A * | 12/1995 | Appleby | 222/212 |
| 5,890,619 | A * | 4/1999 | Belanger | 220/713 |
| 6,073,803 | A * | 6/2000 | Sturm et al. | 222/80 |
| 6,102,245 | A * | 8/2000 | Haberman | 220/714 |
| 6,234,190 | B1 * | 5/2001 | Fischer et al. | 137/68.23 |
| 8,141,730 | B2 * | 3/2012 | Smith et al. | 215/227 |
| 8,448,797 | B2 * | 5/2013 | Cho | 215/228 |

* cited by examiner

DISPENSING CONTAINER

CROSS REFERENCE TO RELATED APPLICATIONS

This application is a national phase of PCT application No. PCT/GB2009/002794, filed Dec. 1, 2009, which claims priority to GB patent application No. 0822447.9, filed Dec. 9, 2008, all of which are incorporated herein by reference.

The present invention relates to dispensing containers and is concerned with that type of container which is intended to dispense a two-component liquid, that is to say a liquid mixed with a further component which may itself be a liquid is preferably a solid, e.g. in powder form. The solid may be soluble in liquid or remain in solid form, e.g. suspended in the liquid. Dispensing containers of this type are desirable for those two-component liquids which are unstable in the long term because one of the components degrades or loses its efficacy over time, when mixed with the other component. Examples of this include a vitamin preparation comprising vitamins in powder form in conjunction with water and hair dye in powder form in conjunction with a solvent. One example in which both components are in liquid form is beverages including a fruit syrup, such as lager and lime.

Dispensing containers of this type are generally made of flexible, resilient material, such as polyethylene, and the liquid within them is commonly dispensed by squeezing the container so as to force the liquid within it to be dispensed through a dispensing opening or the like formed in the container or, more usually, its lid. However, many containers of this type do not return to their original size and shape after a proportion of their contents have been dispensed due to the difficulty in admitting air back into the container to replace the volume of liquid that has been dispensed. Accordingly, once a proportion of the contents of such a container has been dispensed, the aesthetic appearance of the container is frequently impaired and it is also very difficult to dispense the entire contents of the container because it is not possible in practice to apply pressure over its entire area simultaneously. This can result in a proportion of the two-component liquid remaining undispensed within the container at the time the container is finally disposed of. More specifically, the invention is concerned with the type of dispensing container for dispensing a two-component liquid which comprises an outer resilient container for containing one component with a neck defining an opening and an inner container, the outer surface of the inner container being substantially sealed to the inner surface of the neck, the inner container containing a piston member, which is slidably received within it, and a closure member, which closes the lower end of the inner container, the piston member and the closure member defining a reservoir within the inner container for containing the other component, the neck carrying a closure cap which affords a liquid dispensing opening, a first non-return valve communicating with the liquid dispensing opening and with the interior of the inner container, an airflow path extending through the closure cap and the piston member, the airflow path including a second non-return valve, the first non-return valve being arranged to permit liquid to flow from the inner container to the liquid dispensing opening and the second non-return valve being arranged to permit air to flow through the airflow path into the inner container, the closure cap cooperating with the piston member and being movable relative to the neck, whereby movement of the closure cap in the downward direction results in movement of the piston member towards the closure member, which results in movement of the closure member and thus opening of the lower end of the inner container.

A dispensing container of this type is disclosed in WO 2008/059204. In this known container, the closure member constitutes an integral part of the inner container and has a central aperture formed in it, formed concentrically around which is a number of folds of alternating sense. The piston member is integral with the closure cap and carries a central projection, which normally extends into and seals the opening in the closure member. If the closure cap and piston are moved downwardly, that is to say towards the closure member, the pressure within the sealed space between the piston member and the inner container is increased and this pressure acts on the closure member and causes its portions on opposite sides of the fold lines to rotate in opposite directions, whereby the closure member is moved downwardly by the pressure such that the projection on the piston is caused to move out of the hole in the closure member. The second component, which is in liquid form and is accommodated within the reservoir defined by the piston member and the inner container can then flow out of the inner container through the opening in the closure member through the relatively narrow gap defined between the edges of the opening and the projection on the piston. Whilst this container is very effective when both components are in liquid form, it simply does not work when the second component accommodated within the reservoir is in solid form, e.g. granular or particulate, because it will not flow out through the opening in the closure member.

Accordingly, it is the object of the present invention to provide a dispensing container for dispensing a two-component liquid which is suitable for use with one liquid and one solid component and is both cheap and reliable and also simple to manufacture and fill and it is a further object of the invention to provide such a dispensing container which will automatically be refilled by air after a proportion of its contents has been dispensed, thereby retaining the aesthetic appearance of the container and permitting all of its contents to be dispensed.

According to the present invention, a dispensing container for dispensing a two-component liquid of the type referred to above is characterised in that the inner container is of tubular shape, that the closure member extends over substantially the entire cross-sectional area of the inner container and that the piston member is so constructed that when the closure cap moves downwardly the piston member, or a member connected to it, contacts the closure member and moves it and thus opens the inner container.

Thus in the container in accordance with the invention, the outer container will contain one component which will usually be a liquid, of the two-component liquid and the inner container will contain the other component, which may again be a liquid but is preferably a solid, e.g. in powder or granule form. When the closure cap is moved downwardly, the piston member is moved downwardly also and this downward movement results in the piston member or a member connected to it contacting and thus opening the closure member, thereby permitting the component within the inner container to drop into the outer container. Due to the fact that the closure member is at the bottom of the inner tubular container and the closure member occupies substantially all of the cross-sectional area of the tubular inner container, even a second component in sold form can readily drop out of the reservoir into the outer container. The two components may be then thoroughly mixed together, e.g. by shaking the container, and the container may then be inverted and squeezed. The application of pressure to the outer container results in an increase in the pressure within the outer container and this is transmitted to the first non-return valve which opens to permit the mixture, that is to say the two-component liquid, to flow through the non-return valve and then through the liquid dispensing opening in the closure cap. That closure opening may discharge directly into the atmosphere or it may communicate with a spout or a dispensing head, depending on the nature of the two-component liquid. When the desired amount of the liquid has been dispensed, the dispensing container is restored to its previous orientation and the pressure applied to its wall is removed. This results in a decrease in the internal pressure in the outer container and this pressure reduction causes the first non-return valve to close and the second non-return valve to open, thereby permitting air to be drawn in through the airflow path into the outer container to replace the volume of the liquid that has been dispensed. This will permit the outer container to return to its original shape under its own resilience. Due to the fact that the second non-return valve opens immediately the pressure in the container falls to sub-atmospheric, the liquid or paste in the delivery path is not sucked back into the outer container but instead remains in the delivery path. This means that if the container is reinverted and pressure is again applied to it, dispensing of the two components liquid will start immediately.

The closure cap and the mechanism which permits it to be movable relative to the neck may be of any desired type but in the preferred and simplest construction the closure cap includes a depending peripheral skirt carrying an internal screwthread in mesh with an external screwthread on the neck of the container. Thus when it is desired to dispense the contents of the container, the closure cap is screwed further onto the neck of the bottle, thereby moving it downwardly. This downward movement is then transmitted to the piston member and from there to the closure member, which is caused to open. In order to prevent the lid from being screwed down inadvertently, that is to say at a time when it is not desired to mix the two components within the container, the closure cap may be provided with a tear-off band or some such similar mechanism which requires actuation or removal before rotation of the closure cap is possible.

The first non-return valve, through which the two-component liquid flows, preferably forms part of or is carried by the piston member. The second non-return valve is situated in the airflow path and in the preferred embodiment it too is carried by the piston member. In one embodiment, the closure cap and the piston member define a space with which the liquid dispensing opening communicates and which forms part of the airflow path. In this case, both the two-component liquid and air will both flow through the same space. In an alternative embodiment, the closure cap and the piston member define a liquid space and an air space which are sealed from one another, the first non-return valve and the liquid dispensing opening communicating with the liquid space and the air space forming part of the airflow path.

The non-return valves may be of a variety of different types and in one simple embodiment they each comprise an opening cooperating with a resilient valve member, which is biased into a position in which it closes the opening. In an alternative embodiment, the two non-return valves are of known duckbill type. A duckbill non-return valve comprises two resilient sheets of material which are inclined to one another at a small angle and are in contact with one another under a biasing force at one end. The contacting ends of the plates normally maintain a seal but if the pressure acting on the plates should increase beyond a threshold level, they are forced apart to permit fluid to flow between them. When the pressure acting on the plates again falls below the threshold level, the two plates are returned to a position in which they form a seal with one another under the restoring force exerted by their own resilience.

As mentioned above, the outer surface of the inner container is sealed to the inner surface of the neck and this is likely in practice to be at a position close to the rim of the neck. That portion of the inner container which is situated below this point, that is to say further within the outer container, will necessarily not be of a greater diameter than the minimum internal diameter of the neck since otherwise it would not be possible to insert it into the outer container. However, the neck of a bottle is typically divergent from the rim of the bottle or a position shortly below the rim and this is likely to mean in practice that an annular space, whose width increases in the downward direction, is defined between the inner and outer containers. When the container is inverted for the dispensing of its contents, a certain proportion of the contents will enter this annular space and it would normally not be possible for this proportion of the liquid to be dispensed at all. This would potentially result in the wastage of a proportion of the contents of the container. This problem is, however, overcome if the piston member is movable, when the closure cap is moved downwardly, from a rest position to an actuated position and an annular space is defined between the inner surface of the outer container and the outer surface of the inner container, an aperture being formed in the inner container which connects the annular space with the interior of the inner container, the piston member having a peripheral skirt in sliding contact with the inner surface of the inner container, an aperture being formed in the peripheral skirt which is in registry with the aperture in the inner container, when the piston member is in the actuated position.

Further features and details of the invention will be apparent from the following description of two exemplary embodiments which is given by way of example only with reference to the accompanying drawings, in which.

Figure 1:
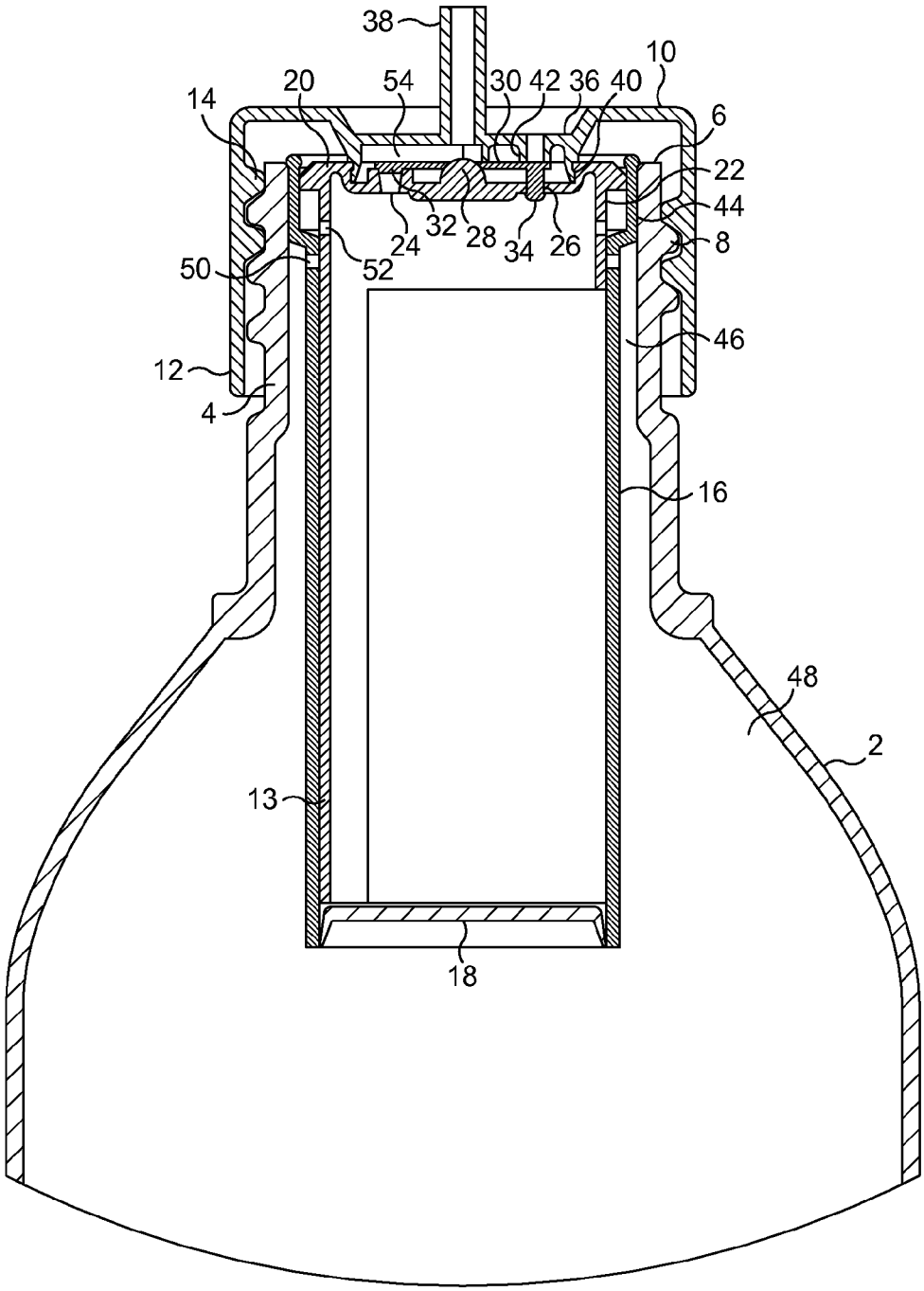
FIG. 1 is a vertical sectional view of the upper portion of a first embodiment of dispensing container in accordance with the invention in the closed condition.
Figure 2:
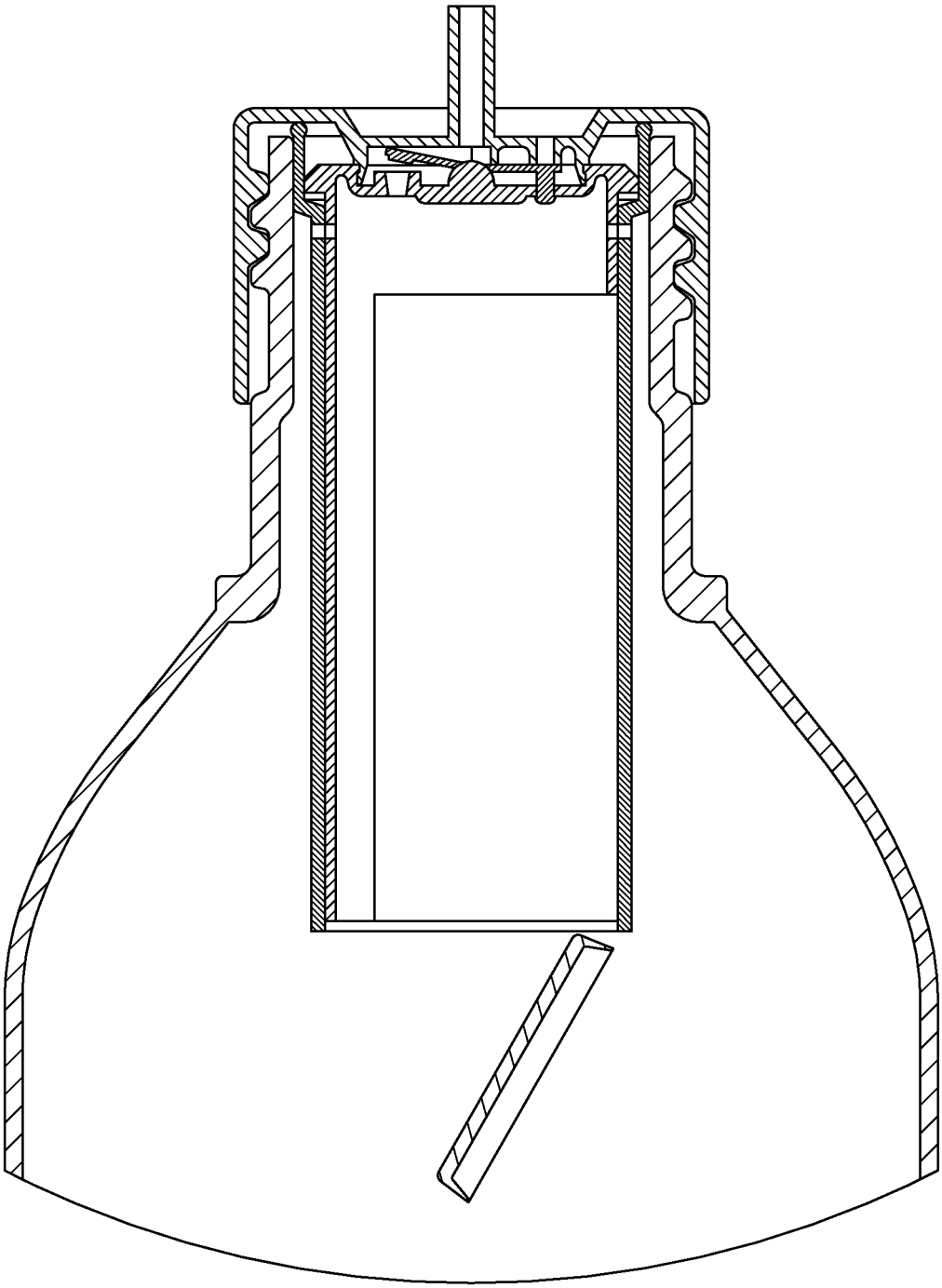
FIG. 2 is a view similar to FIG. 1 showing the container in the course of being opened after the inner container has been opened.

Referring firstly to FIGS. 1 and 2, the dispensing container includes an outer container 2 of flexible, resilient material, such as polyethylene. At its upper end, the container has a neck 4, which terminates in a rim 6 and carries an external screwthread 8. The container 2 is closed by a closure cap including a substantially circular portion 10, which extends over the mouth of the bottle and the rim, integral with the outer edge of which is a depending peripheral skirt 12, which carries an internal screwthread 14 in mesh with the screwthread 8. Accommodated within the neck 4 of the container 2 and extending down into the body of the container 2 is an inner container 16 in the form of a circular plastic tube. The lower end of the inner container 16 is normally closed by a closure member 18, which in this case is not connected to the container 16 but could be connected to it by a flexible integral hinge. When the closure member 18 is in the closed position, it is received as a push fit within the lower end of the container 16 and its outer periphery forms a substantially gas-tight seal with the inner surface of the container 16. FIG. 1 shows the closure member 18 in the closed configuration.

Accommodated within the upper end of the container 16 is a piston, which includes a circular crown portion 20, integral with whose outer edge is a depending skirt 22 in sliding, sealed contact with the inner surface of the container 16. Formed in the crown portion 20 is a liquid exit opening 24 and an air entry opening 26. Upstanding from the upper surface of the crown portion 20 is a protuberance 28, which carries a sealing member 30, which extends in the diametral direction and carries, at one end, a sealing protuberance 32, which cooperates with and normally seals the liquid exit opening 24, and, at the other end, a depending sealing protuberance 34, whose width increases in the downward direction and which is accommodated in and normally seals the air entry opening 26. Formed centrally in the disc-shaped portion 10 of the closure cap is a recessed portion 36, upstanding from which is a hollow discharge spigot 38. Depending from the outer edge of the recessed portion 36 is an annular flange 40, which engages and forms a seal with the crown portion 20 of the piston. Also depending from the recessed portion 36 of the closure cap is a short tubular spigot 42, which defines an air entry passage. Integral with and depending from the piston skirt 22 is a projection or finger 13, which extends nearly to the lower end of the tubular container 16. In this case the finger extends only around a small proportion of the periphery of the skirt but this proportion may be varied as desired.

The outer surface of the inner container 16 is sealed to the inner surface of the neck 4 of the outer container at a region 44 closely below the rim 6. Over the remainder of the height of the neck 4, there is a narrow gap 46 between the neck and the inner container. Below the neck 4, the wall of the outer container 2 diverges outwardly and the lower portion of the container 16 therefore defines with the wall of the container 2 an annular space 48, whose width increases in the downward direction. Formed in the wall of the inner container 16 at a position very shortly below the sealed region 44 is a number of openings 50. Formed in the depending skirt 22 of the piston at angular positions corresponding to those of the openings 50 are the same number of further openings 52. The purpose of the openings 50 and 52 will be described below.

In use, the outer container 2 is substantially filled with one component, typically a liquid, of a two-component liquid or pourable composition. The closure member 18 is push fitted into the lower end of the inner container 16 and its periphery forms a gas-tight seal with the inner surface of the container 16. The space defined within the container 16 between the piston 20, 22 and the closure member 18 constitutes a reservoir which accommodates the second component of the two-component liquid, typically a solid in powder or granular form. The liquid exit opening 24 is sealed by the sealing protuberance 32 by virtue of the resilience of the sealing member 30 and the air entry opening 26 is sealed by the head of the sealing protuberance 34. If it is now desired to dispense the two-component liquid, the closure cap 10, 12 is firstly screwed down further onto the neck of the outer container, thereby moving the closure cap downwardly. This downward movement is transmitted by the flange 40 to the piston 20, 22, which is thereby moved downwardly also. This downward movement of the piston results in the finger 13 contacting the closure member 18 and forcing it out of the container 16, as shown in FIG. 2. The lower end of the container 16 is now open and the second component within it then falls into the first component within the outer container 2. The container is then shaken to mix the two components thoroughly. The container is then inverted and a pressure is applied by the user to the wall of the container 2, thereby deforming it inwardly and increasing the pressure in the interior of the two containers. This increased pressure acts on the sealing member 30 via the sealing protuberance 32 and the arm of the sealing member 30 carrying the protuberance 32 is thereby bent upwardly, as shown in FIG. 2, to open the liquid exit opening 20. The liquid is thus caused to flow into the space 54 defined between the piston crown 20 and the depressed portion 36 of the closure cap. The space 54 communicates with the interior of the discharge spigot 38 and the liquid is therefore dispensed through the spigot 38. The increased pressure within the container 2 acts also on the underside of the sealing protuberance 34 and thus urges it upwardly. Due to the fact that the sealing protuberance 34 is of increasing diameter in the downward direction, this force on the sealing protuberance 34 increases the integrity of the seal of the air entry opening 26 and no liquid can therefore flow through that opening. The airflow path is also sealed by engagement of the upper surface of the sealing member 30 with the underside of the spigot 42. When the desired amount of the two-component liquid has been dispensed, the container is returned to its initial orientation and the pressure applied to the wall of the container 2 is removed. This results in the production of a sub-atmospheric pressure in the container 2 and the sealing protuberance 32 returns under the action of this reduced pressure and the resilience of the sealing member 30 from the open position shown in FIG. 2 to the closed position shown in FIG. 1. However, the reduced pressure within the container 2 also acts on the underside of the sealing protuberance 34, which is thus caused to move downwardly, thereby slightly opening the air entry opening 26. This downward movement results also in the seal between the upper surface of the sealing member 30 and the lower surface of the spigot 42 being broken, whereby there is now an uninterrupted air entry path into the container 2. Air therefore flows into the container to replace the liquid that has been dispensed until the pressure within the container reaches atmospheric value. The upper surface of the sealing member 30 then returns under its own resilience into sealing contact with the underside of the spigot 42, whereby the interior of the container is again sealed.

When the container is inverted, the two-component liquid will of course flow into the annular space 48 and thus also into the narrow gap 46. This is not a problem but when the outer container 2 is nearly empty and the level of the liquid has sunk to the level of the free end of the container 16, when the container 2 is inverted, the liquid in the annular space 48 would be trapped and it would not be possible to dispense it. However, as may be seen in FIGS. 3 and 4, when the piston has been moved downwardly by screwing down the closure cap, the openings 52 in its skirt are in registry with the openings 50 in the inner container 16 and these openings are of course in communication with the gap 46 and thus also with the annular space 48. Accordingly, when the container 2 is nearly empty, the action of the increased pressure in the container 2 created by squeezing its side wall will act on the liquid in the annular space 48 and force it through the gap 46 and then through the openings 50 and 52 into the interior of the inner container 16, from which it can be dispensed in the normal manner through the exit opening 24.

Figure 3:
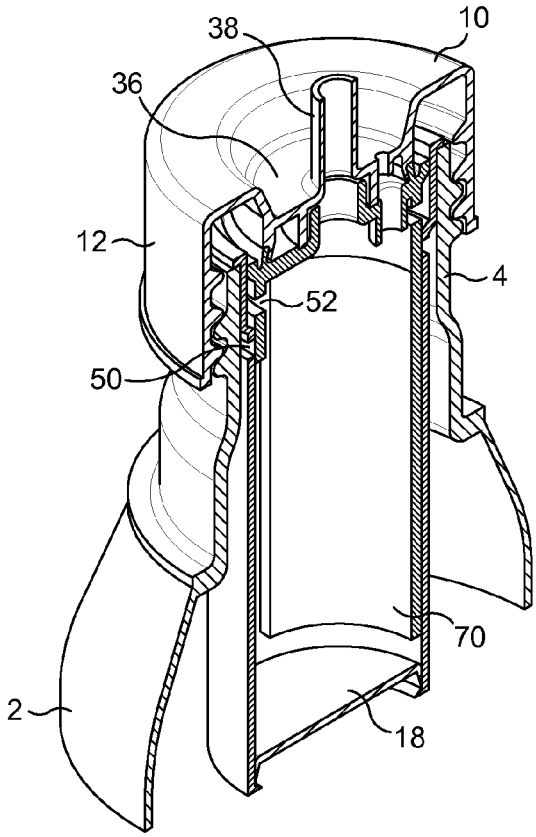
FIG. 3 is an axially cutaway view of a second embodiment of dispensing container in accordance with the invention.
Figure 4:
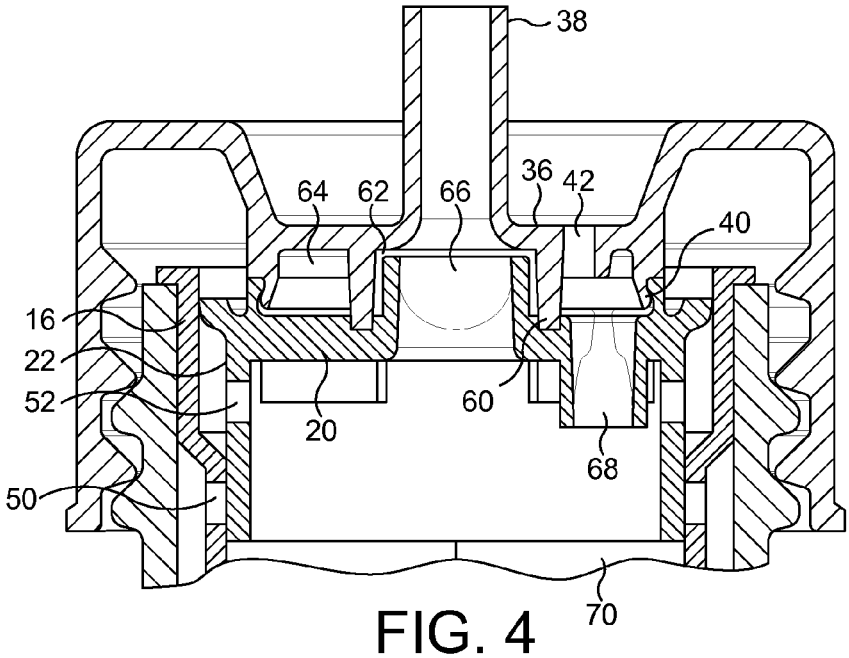
FIG. 4 is an axial sectional view on an enlarged scale of the upper portion of the container shown in FIG. 3.

The modified embodiment shown in FIGS. 3 and 4 is generally similar to that shown in FIGS. 1 and 2 and only those elements which differ from FIGS. 1 to 2 will therefore be described. In this case, depending from the recessed portion 36 of the closure cap are not only the sealing flange 40 but also a further annular sealing flange 60. The sealing flange 60 defines between the closure cap and the piston crown 20 a liquid space 62, which communicates with the interior of the discharge spigot 38. Defined by the flanges 40 and 60 between the piston crown 20 and the recessed portion 36 of the closure cap is an air space 64, which communicates with the atmosphere via an air passage 42. The liquid space 62 communicates with the interior of the inner container 16 via a non-return valve 66 of duckbill type integral with the piston crown. The air space 64 communicates with the interior of the container 16 via a further non-return valve 68, which is also of duckbill type and formed integrally with the piston crown. In this case, the depending skirt 22 of the piston is provided with a downward extension 70 over half of its periphery which extends, when the piston is in its uppermost, that is to say non-actuated, position, to a position only shortly above the closure member 18. When the closure cap is screwed further onto the neck of the container so as to move it downwardly, thereby moving the piston downwardly also, the extension 70 moves into contact with the closure member 18 and forcibly moves it downwards, thereby opening the lower end of the inner container 16. In other respects, the structure and operation of the second embodiment are essentially the same as that of the first embodiment.

The invention claimed is:

1. A dispensing container for dispensing a two-component liquid comprising an outer resilient container for containing one component with a neck defining an opening and an inner container, an outer surface of the inner container being substantially sealed to an inner surface of the neck, the inner container containing a piston member, which is slidably received within the inner container, and a closure member, which closes a lower end of the inner container, the piston member and the inner container defining a reservoir for containing the other component, the neck carrying a closure cap having a liquid dispensing opening, a first non-return valve communicating with the liquid dispensing opening and with the interior of the inner container, an airflow path extending through the closure cap and the piston member, the airflow path including a second non-return valve, the first non-return valve being arranged to permit liquid to flow from the inner container to the liquid dispensing opening and the second non-return valve being arranged to permit air to flow through the airflow path into the inner container, the closure cap cooperating with the piston member and being movable relative to the neck, whereby movement of the closure cap in the downward direction moves the piston member towards the closure member, which moves the closure member, thereby opening the lower end of the inner container, characterised in that the inner container has a tubular shape, that the closure member extends over substantially the entire cross-sectional area of the inner container and that when the closure cap moves downwardly the piston member, or a member connected to the piston member, contacts the closure member and moves the closure member, thereby opening the inner container, wherein the closure cap and the piston member define a liquid space and an air space, which are sealed from one another, the first non-return valve and the liquid dispensing opening communicating with the liquid space and the air space forming part of the airflow path.

2. A container as claimed in claim 1, wherein the closure cap includes a depending peripheral skirt carrying an internal screwthread in mesh with an external screwthread on the neck of the container.

3. A container as claimed in claim 1, wherein the closure member is a push fit within the inner container.

4. A container as claimed in claim 1, wherein the closure member forms a substantially air-tight seal with the internal surface of the inner container.

5. A container as claimed in claim 1, wherein the piston member carries the first and second non-return valves.

6. A container as claimed in claim 5, wherein the closure cap and the piston member define a space, the liquid dispensing opening communicating with the space and the space forming part of the airflow path.

7. A container as claimed in claim 1, wherein the two non-return valves comprise an opening cooperating with a resilient valve member biased into a position to close the opening.

8. A container as claimed in claim 1, wherein the two non-return valves are of duckbill type.

9. A dispensing container for dispensing a two-component liquid comprising an outer resilient container for containing one component with a neck defining an opening and an inner container, an outer surface of the inner container being substantially sealed to an inner surface of the neck, the inner container containing a piston member, which is slidably received within the inner container, and a closure member, which closes a lower end of the inner container, the piston member and the inner container defining a reservoir for containing the other component, the neck carrying a closure cap having a liquid dispensing opening, a first non-return valve communicating with the liquid dispensing opening and with the interior of the inner container, an airflow path extending through the closure cap and the piston member, the airflow path including a second non-return valve, the first non-return valve being arranged to permit liquid to flow from the inner container to the liquid dispensing opening and the second non-return valve being arranged to permit air to flow through the airflow path into the inner container, the closure cap cooperating with the piston member and being movable relative to the neck, whereby movement of the closure cap in the downward direction moves the piston member towards the closure member, moves the closure member, thereby opening the lower end of the inner container, characterised in that the inner container has a tubular shape, that the closure member extends over substantially the entire cross-sectional area of the inner container and that when the closure cap moves downwardly the piston member, or a member connected to the piston member, contacts the closure member and moves the closure member, thereby opening the inner container, wherein the piston member is movable, when the closure cap is moved downwardly, from a rest position to an actuated position and an annular space is defined between the inner surface of the outer container and the outer surface of the inner container, an aperture being formed in the inner container to connect the annular space with the interior of the inner container, the piston member having a peripheral skirt in sliding contact with the inner surface of the inner container, an aperture being formed in the peripheral skirt and being in registry with the aperture in the inner container when the piston member is in the actuated position.

10. A dispensing container for dispensing a two-component liquid comprising an outer resilient container for containing one component with a neck defining an opening and an inner container, an outer surface of the inner container being substantially sealed to an inner surface of the neck, the inner container containing a piston member, which is slidably received within the inner container, and a closure member, which closes a lower end of the inner container, the piston member and the inner container defining a reservoir for containing the other component, the neck carrying a closure cap having a liquid dispensing opening, a first non-return valve communicating with the liquid dispensing opening and with the interior of the inner container, an airflow path extending through the closure cap and the piston member, the airflow path including a second non-return valve, the first non-return valve being arranged to permit liquid to flow from the inner container to the liquid dispensing opening and the second non-return valve being arranged to permit air to flow through the airflow path into the inner container, the closure cap cooperating with the piston member and being movable relative to the neck, whereby movement of the closure cap in the downward direction moves the piston member towards the closure member, which moves the closure member, thereby opening the lower end of the inner container, characterised in that the inner container has a tubular shape, that the closure member extends over substantially the entire cross-sectional area of the inner container and that when the closure cap moves downwardly the piston member, or a member connected to the piston member, contacts the closure member and moves the closure member, thereby opening the inner container, wherein the piston member carries the first and second non-return valves, and wherein the closure cap and the piston member define a liquid space and an air space, which are sealed from one another, the first non-return valve and the liquid dispensing opening communicating with the liquid space and the air space forming part of the airflow path.

11. A container as claimed in claim 10, wherein the closure cap includes a depending peripheral skirt carrying an internal screwthread in mesh with an external screwthread on the neck of the container.

12. A container as claimed in claim 10, wherein the closure member is a push fit within the inner container.

13. A container as claimed in claim 10, wherein the closure member forms a substantially air-tight seal with the internal surface of the inner container.

14. A container as claimed in claim 10, wherein the closure cap and the piston member define a space, the liquid dispensing opening communicating with the space and the space forming part of the airflow path.

15. A container as claimed in claim 10, wherein the two non-return valves comprise an opening cooperating with a resilient valve member biased into a position to close the opening.

16. A container as claimed in claim 10, wherein the two non-return valves are of duckbill type.

* * * * *